US011738253B2

(12) United States Patent
Edmond et al.

(10) Patent No.: US 11,738,253 B2
(45) Date of Patent: Aug. 29, 2023

(54) SNOWBOARD BINDING HAVING A HIGHBACK WITH A PLURALITY OF CLOSED POSITIONS DETERMINED BY A BLOCKING MEANS WITH A PLURALITY OF CATCHES

(71) Applicant: NIDECKER S.A., Rolle (CH)

(72) Inventors: Jean-Pierre Edmond, Annemasse (FR); Daniel Schmäh, Etoy (CH); Thierry Kunz, Saint-Prex (CH)

(73) Assignee: NIDECKER S.A., Rolle (CH)

( * ) Notice: Subject to any disclaimer, the term of this patent is extended or adjusted under 35 U.S.C. 154(b) by 0 days.

(21) Appl. No.: 17/786,106

(22) PCT Filed: Jan. 21, 2021

(86) PCT No.: PCT/EP2021/051393
§ 371 (c)(1),
(2) Date: Jun. 16, 2022

(87) PCT Pub. No.: WO2021/148571
PCT Pub. Date: Jul. 29, 2021

(65) Prior Publication Data

US 2023/0022644 A1 Jan. 26, 2023

(30) Foreign Application Priority Data

Jan. 22, 2020 (FR) ..... 2000618

(51) Int. Cl.
*A63C 10/04* (2012.01)
*A63C 10/24* (2012.01)

(52) U.S. Cl.
CPC ..... *A63C 10/045* (2013.01); *A63C 10/24* (2013.01); *A63C 2203/10* (2013.01)

(58) Field of Classification Search
CPC .... A63C 10/24; A63C 10/045; A63C 2203/10
See application file for complete search history.

(56) References Cited

U.S. PATENT DOCUMENTS 5,957,479 A * 9/1999 Bayer ..... A43B 5/0401 280/624
5,997,027 A * 12/1999 Jungkind ..... A63C 10/045 280/626

(Continued)

FOREIGN PATENT DOCUMENTS

| | | | |
|---|---|---|---|
| EP | 0824942 | A1 | 2/1998 |
| EP | 2949368 | A1 | 12/2015 |
| WO | 2008094974 | A1 | 8/2008 |

OTHER PUBLICATIONS

International Search Report (with English Translation) and Written Opinion (with Machine Translation) dated Apr. 12, 2021, in connection with corresponding International Application No. PCT/EP2021/051393; 14 pages.

*Primary Examiner* — Brian L Swenson
(74) *Attorney, Agent, or Firm* — Maier & Maier, PLLC

(57) ABSTRACT

A snowboard binding including a baseplate, a bearing highback rotatable relative to the baseplate, a pedal to operate the bearing highback at clip-in between an opening position and a closing position and a locking element to lock the rotation of the bearing highback relative to the baseplate in closing position against the elastic return of a lever. The locking element includes two ratchet notches with the lever. The snowboard binding includes a lug that is received into a fork of the locking element with notches or of the lever to rotate the locking element with notches or the lever by unlocking the lever from one of the notches and by locking it with the other notch at clip-in.

7 Claims, 7 Drawing Sheets

(56) References Cited

U.S. PATENT DOCUMENTS

| | | | | |
|---|---|---|---|---|
| 6,196,559 | B1 * | 3/2001 | Cress | A63C 10/10<br>280/14.22 |
| 7,011,334 | B2 * | 3/2006 | Holzer | A63C 10/24<br>280/14.22 |
| 11,130,045 | B2 * | 9/2021 | Pascal | A63C 10/103 |
| 2001/0011801 | A1 * | 8/2001 | Dennis | A63C 10/22<br>280/14.22 |
| 2003/0094790 | A1 * | 5/2003 | Poscich | A63C 10/10<br>280/618 |
| 2004/0232658 | A1 * | 11/2004 | Poscich | A63C 10/10<br>280/618 |
| 2016/0175689 | A1 | 6/2016 | Chen et al. | |
| 2019/0290995 | A1 * | 9/2019 | Flannery | A63C 10/106 |

* cited by examiner

SNOWBOARD BINDING HAVING A HIGHBACK WITH A PLURALITY OF CLOSED POSITIONS DETERMINED BY A BLOCKING MEANS WITH A PLURALITY OF CATCHES

FIELD

The invention relates to a snowboard binding including, more specifically, a baseplate, a bearing highback rotatable relative to the baseplate, and a pedal to operate the bearing highback at clip-in by rotation relative to the baseplate between an opening position and a closing position. A means is designed to lock the rotation of the bearing highback relative to the baseplate in closing position against the elastic return of a lever. The means features two ratchet notches with the lever.

BACKGROUND

A snowboard binding of that kind is disclosed in the document US 2016/0175689. According to this document, the means designed to lock the bearing highback relative to the baseplate features a spout inside a recess designed in both lateral arms of the pedal to snap with the elastic-return lever mounted around a rotation axis relative to the baseplate. The two spouts form two ratchet notches with two ends of the lever opposite to the rotation axis and received into the recesses of the lateral arms of the pedal. Another example of the kind of snowboard binding is disclosed by the document EP 0824942, in which both notches result from an indentation inside the two lateral arms of the pedal to snap with the elastic-return lever mounted around a rotation axis relative to the baseplate. In another example disclosed by the document WO 2008/094974, both notches result from a latch clamped on each side of the pedal to snap with the elastic-return lever mounted on the baseplate.

In either one of these documents, the elastic-return lever is manually toppled to unlock the bearing highback from the closing position and allow the clip-out.

The prior art from these documents shows a restriction to only one closing position of the binding of the snowboard. Its drawback comes out particularly when snow builds between the pedal and the baseplate. In this very common condition, it may be impossible to rotate the bearing highback to the closing position, hence to snap the elastic-return lever with the locking means.

SUMMARY

One of the purposes of the invention is to modify the type of snowboard binding above to secure the locking of the bearing highback in closing position in any circumstances.

To this purpose, the object of the present invention is a snowboard binding according to the introductory statement, characterized in that it features a lug that is received into a fork of the means with notches or of the lever to rotate the locking means or the lever by unlocking the lever from one of the notches and by locking it with the other notch at clip-in.

This way, by driving the fork thanks to the lug, the snowboard binding according to the invention allows the lever to snap in various closing positions at clip-in according to the different notches of the locking means.

The lug can be static in the baseplate, the bearing highback or the pedal.

In a first embodiment of the invention, the means with notches features a wheel with a recess that defines the lug-receiving fork. The wheel can be rotatable relative to the bearing highback while the lug can be static in the baseplate. Alternatively, the wheel can be rotatable relative to the baseplate while the lug can be static in the bearing highback or the pedal.

According to a second embodiment of the invention, the lever features a first arm rotatable relative to the side of the bearing highback and a second arm that is joint to the first arm and snapped with the means with notches, being static in the bearing highback, wherein the first arm features a recess that defines the fork opposite to the second arm, while the lug is static in the baseplate.

According to a variant of the first embodiment of the invention, the lug is supported by a side of the bearing highback.

According to a variant of the second embodiment of the invention, the first arm of the lever is a hoop joint to two sides of the bearing highback.

These variants are particularly advantageous when a bottom of the bearing highback or the baseplate features a hinge bearing mounted around the rotation axis of the bearing highback relative to the baseplate, which is used as a guiding stop in any position of the bearing highback between the opening position and the closing positions at clip-in and clip-out.

BRIEF DESCRIPTION OF THE FIGURES

Other advantages of the invention are described in the presentation below as in the following pictures.

Figure 1:
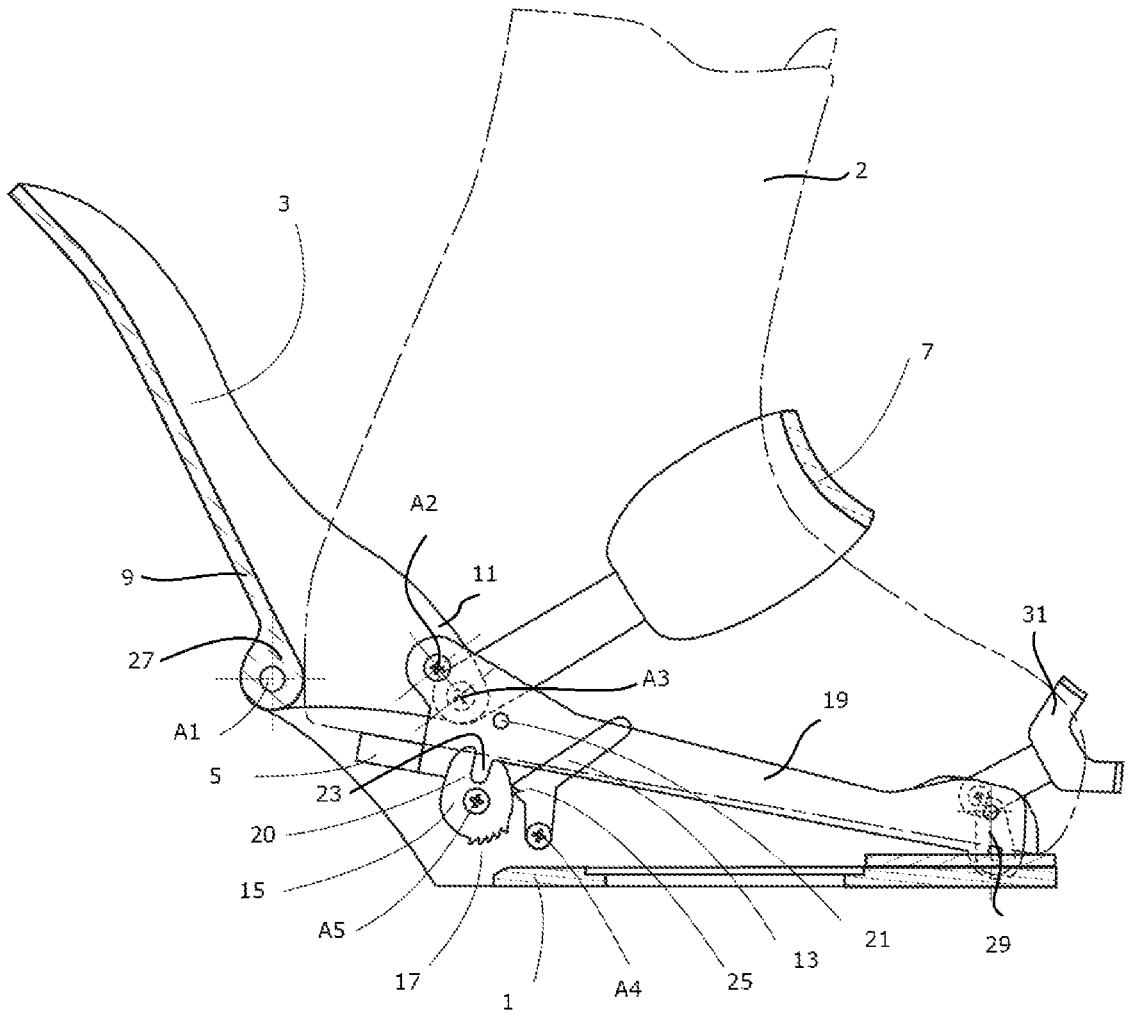
FIG. 1 is a side view of an example of the first embodiment of the invention, where the lug is supported by the pedal.

It should be noted that each item has the same reference on all figures in the following statement.

DETAILED DESCRIPTION

A snowboard binding as pictured in any of the FIGS. 1 to 7 features a baseplate 1, a bearing highback 3, a pedal 5 and a strap 7. The bearing highback 3 is rotatable around the rotation axis A1 supported by the baseplate 1. The pedal 5 and the strap 7 are designed to operate the bearing highback 3 respectively at clip-in and clip-out between an opening position and a closing position. The bearing highback 3 features a bottom 9 and two sides 11. The pedal 5 is jointed to the two sides 11 around a rotation axis A2. The strap 7 is jointed to the bearing highback 3 around a rotation axis A3. A means 15, 16 is designed to lock the rotation of the bearing highback 3 relative to the baseplate 1 in closing position against an elastic-return lever 13, 13*a*, 13*b*. This means 15, 16 features at least two ratchet notches 17.

The elastic-return lever features a maneuver arm 12 for manual release in order to unlock the bearing highback from the closing position and allow the clip-out.

According to the invention, the snowboard binding features a lug 21 that is received into a fork 20 of the means 15, 16 with notches 17 or of the lever 13, 13*a*, 13*b* to rotate the means with notches or the lever by unlocking the lever from one of the notches 17 and by locking it with the other notch 17 at clip-in.

The FIGS. 1 to 4 show a first embodiment, when the means 15 with notches 17 features a cam or a wheel with a recess 23 that defines the fork 20 that will receive the lug 21.

Figure 2:
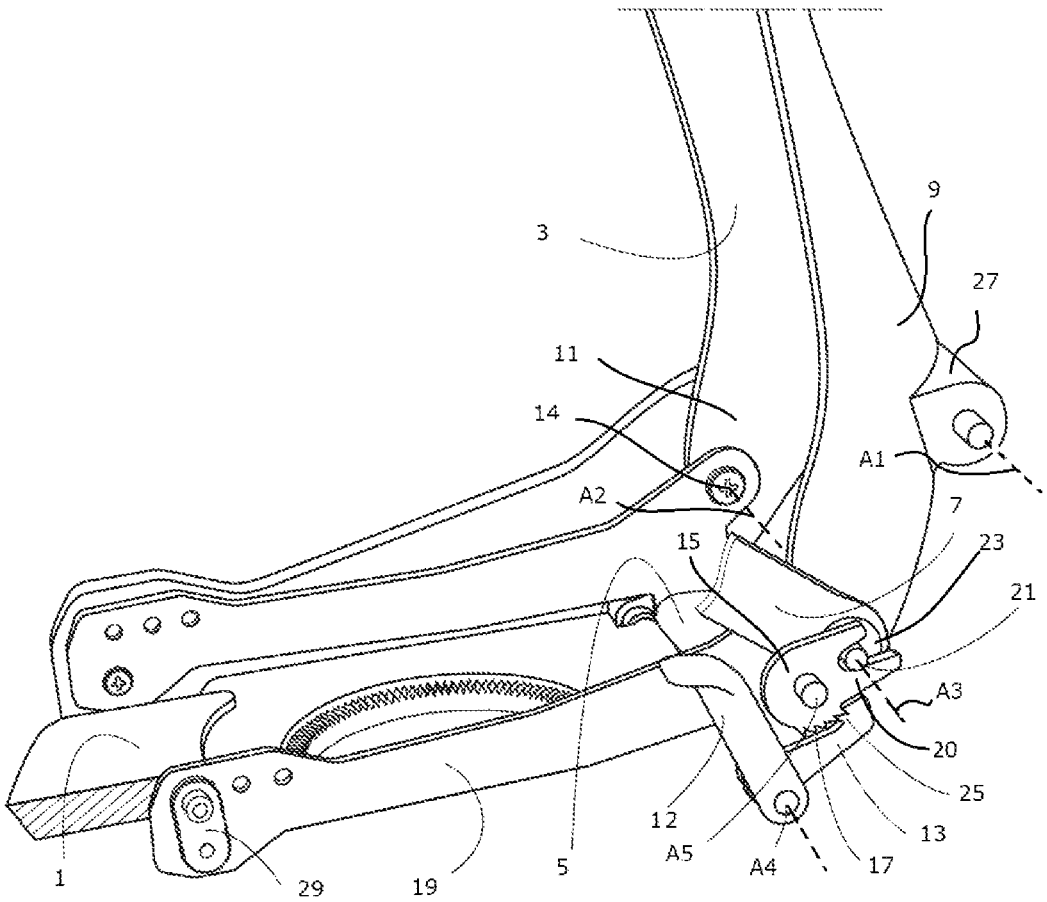
FIG. 2 is a side view of an example of the first embodiment of the invention, where the lug is supported by the bearing highback.
Figure 3:
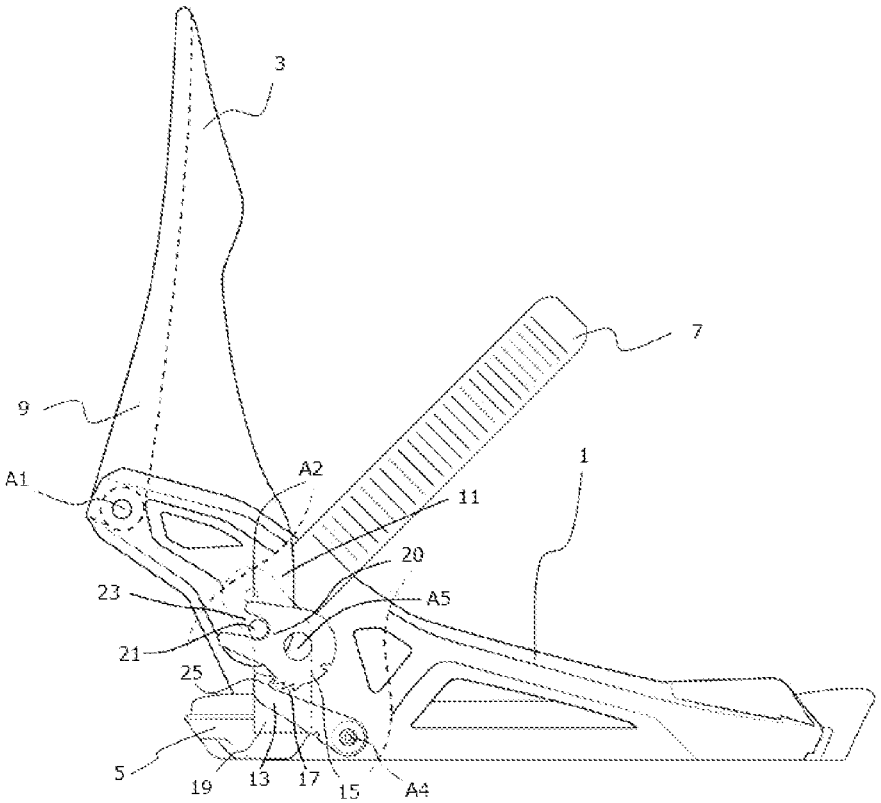
FIG. 3 is a side view of another example of the first embodiment of the invention, where the lug is supported by the bearing highback.

In the example of the FIG. 1, 2 or 3, the wheel 15 is supported by the baseplate 1 around a rotation axis A5, so that it is operated by the lug 21 that is supported (FIG. 1) by two lateral arms 19 that support the pedal 5, or that is supported (FIG. 2 or 3) by the sides 11 of the bearing highback, in this case along the axis A3 of the joint of the strap 7.

The elastic-return lever 13 is rotatable relative to the baseplate 1 around a rotation axis A4 and features a notch 25 to snap with the notches 17 of the wheel 15. The elastic return of the lever 13 results from a mean known by itself and not displayed on the figures, for example a spring, and allows the lever to move to end position against the wheel 15 while the lug 21 drives the wheel in rotation.

While the bearing highback 3 is driven in rotation around the axis A1 of the pedal 5 at clip-in, the lug 21 driving the wheel 15 allows the lever 13 to unlock one notch 17 to snap with the following notch, so that the wheel 15 operates the various successive closing positions according to the succession of notches.

Figure 4:
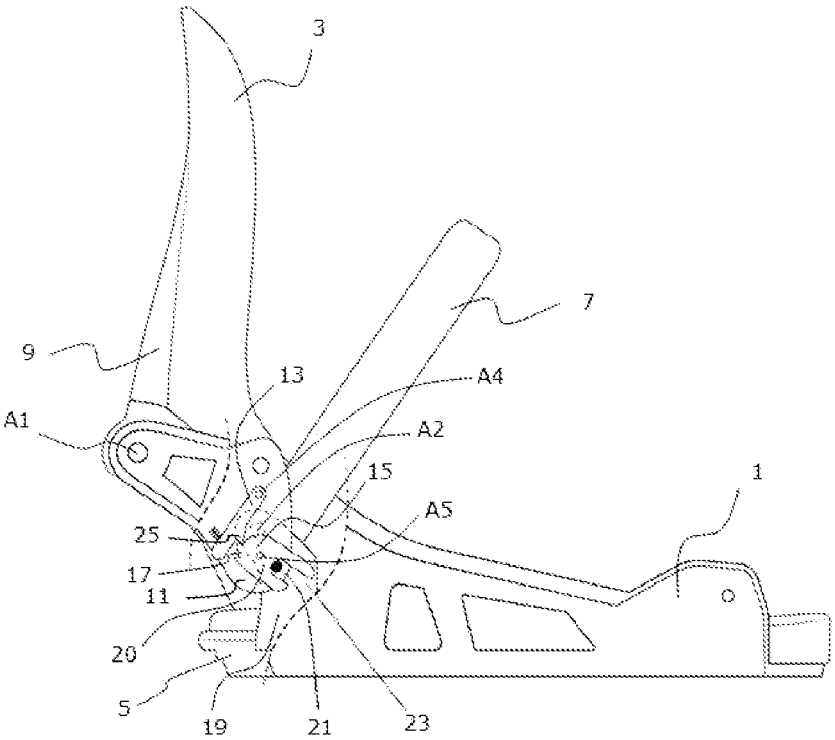
FIG. 4 is a side view of an example of the first embodiment of the invention, where the lug is supported by the baseplate.

In the example of FIG. 4, the wheel 15 is rotatable relative to the sides 11 of the bearing highback while the lug 21 is fixed to the baseplate 1. The elastic-return lever 13 is also rotatable relative to the sides 11 of the bearing highback. In this embodiment, it should be noted that the lateral arms 19 of the pedal 5 are only jointed to the bearing highback 3, while they are jointed to the baseplate 1 too in the embodiment of the FIG. 3.

Figure 5:
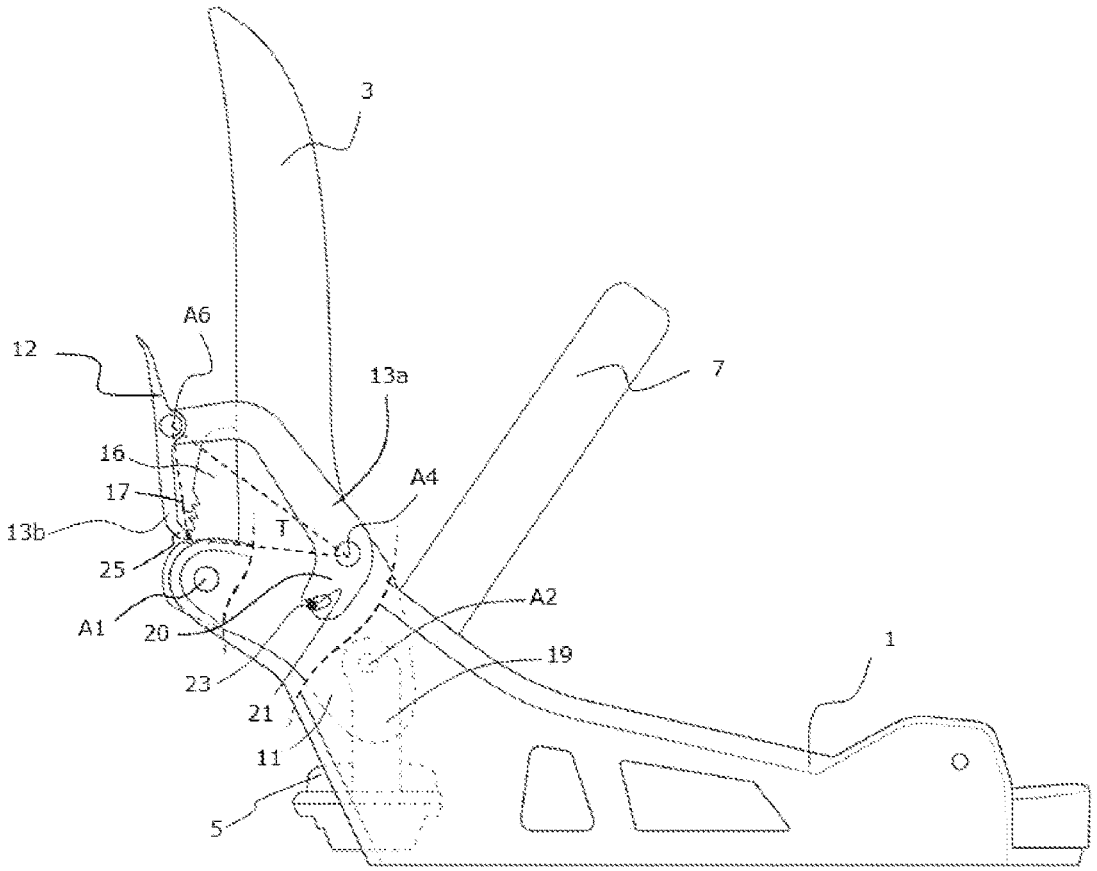
FIG. 5 is a side view of an example of the second embodiment of the invention, where the lug is supported by the baseplate, showing a first closing position.
Figure 6:
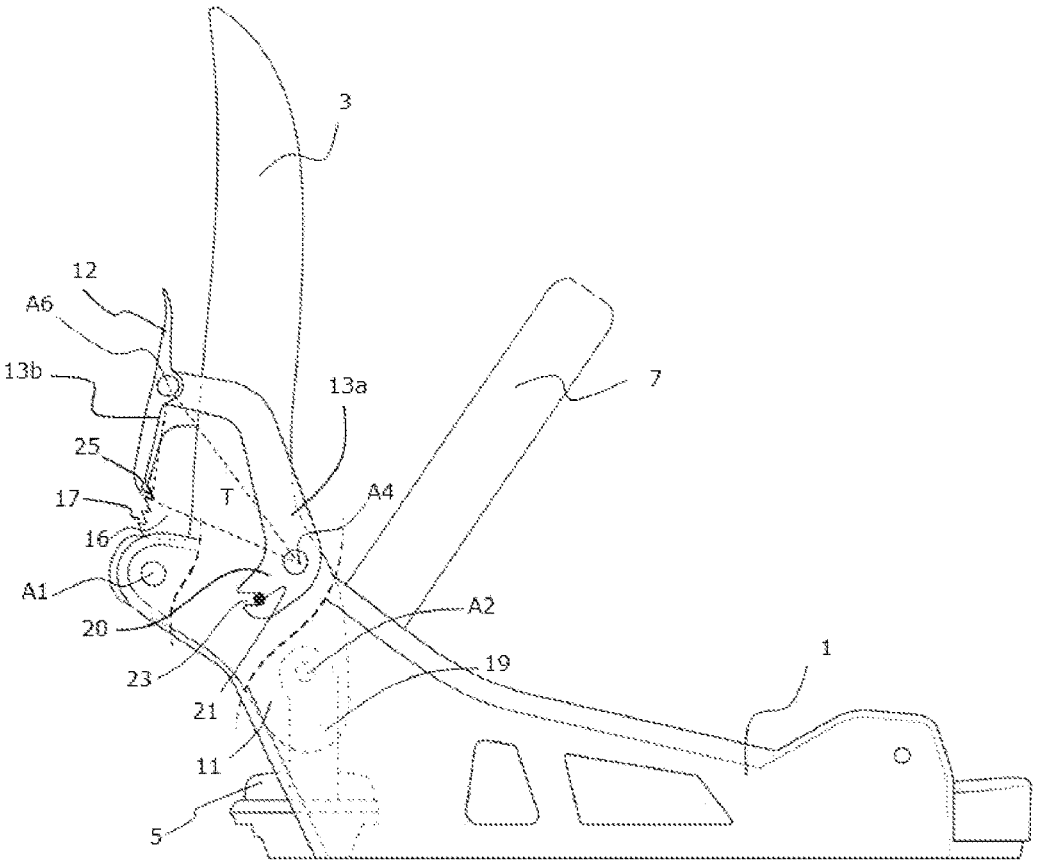
FIG. 6 is a side view of an example of the second embodiment of the invention, where the lug is supported by the baseplate, showing a second closing position.

The FIGS. 5 and 6 show a second embodiment, where the lever 13 features a first arm 13*a* rotatable relative to the bearing highback 3 around a rotation axis A4 and a second arm 13*b* that is joint to the first arm 13*a* around a rotation axis A6 and snapped with the means 16 with notches 17, which is fixed to the bearing highback 3. The first arm 13*a* features a recess 23 that defines the fork opposite to the second arm 13*b*, while the lug 21 is static in the baseplate 1. While the bearing highback 3 is driven in rotation around the axis A1 of the pedal 5 at clip-in, the lug 21 driving the first arm 13*a* allows the second arm 13*b* to unlock one notch 17 to snap with the following notch, so that the means 16 operates the various successive closing positions according to the succession of notches.

It should be noted that any notch of the means 16 forms a locking triangle T with the joint of the first arm to the bearing highback and the joint of the second arm to the first arm in any closing position of the bearing highback. The FIG. 5 show a closing position defined by a first notch, while in the FIG. 6, the closing position is defined by a last notch.

The FIGS. 1 to 6 show the invention, in particular in the case where the bottom 9 of the bearing highback or the baseplate 1 features a hinge bearing 27 mounted around the rotation axis A1, which is used as a guiding stop in any position of the bearing highback 3 between the opening position and the various closing position at clip-in and clip-out. The guiding stop guides and pre-positions the boot 2 of a user in any position between the opening position and the various closing positions. Thus, at clip-in, in the final stage of closing, there is nearly no horizontal sliding of the boot relative to the baseplate.

Both arms 19 that support the pedal 5 are rotatable around the second rotation axis A2 thanks to two joints that operate rivets 14, for example. The pedal 5 operates the bearing highback 3 automatically into the closing position, without any manual action. The arms 19 transmit a thrust from the boot 2 of the user to the bearing highback 3 while producing a drive torque from the initial opening position to one of the final closing positions according to the last notch 17 of the locking means 15 that is snapped with the elastic-return lever 13, 13*a*, 13*b*.

In the illustrative examples of the FIGS. 1 and 2, two connecting rods 29 are jointed to the arms 19 and to the baseplate 1 to increase the accuracy of the guidance of the pedal 5. This guiding system allows the arms 19 to move forwards to the front part of the baseplate 1, then to move backwards to the rear part during the rotation of the bearing highback 3 around the rotation axis A1. In other words, the connecting rod 21 absorbs an horizontal component of the movement of the arms 19. The connecting rods 29 are jointed to the front part of the baseplate 1 to untie a front strap 31 in the opening position at FIG. 1.

In the illustrative example in the FIGS. 5 and 6, the first arm 13*a* of the lever 13 is a hoop, on which the second arm 13*b* is joint. When the hoop is jointed with the two sides of the bearing highback 11, it advantageously cooperates with a unique means 16 with notches 17 mounted on the bearing highback to spread in a balanced fashion the driving of the two sides 11 of the bearing highback by the lug 21. This prevents the snapped notches on either side 11 of the bearing highback no to be homologous and lead to a slight twisting of the bearing highback 3.

Reference is made to the application PCT/EP2019/069605 by the applicant, that is appended about the particular arrangement between the bearing highback and the baseplate thanks to a hinge bearing as a guiding stop.

It should be noted, however, that the whole invention applies to any snowboard binding that features a bearing highback rotatable relative to the baseplate according to the introductory statement.

Figure 7:
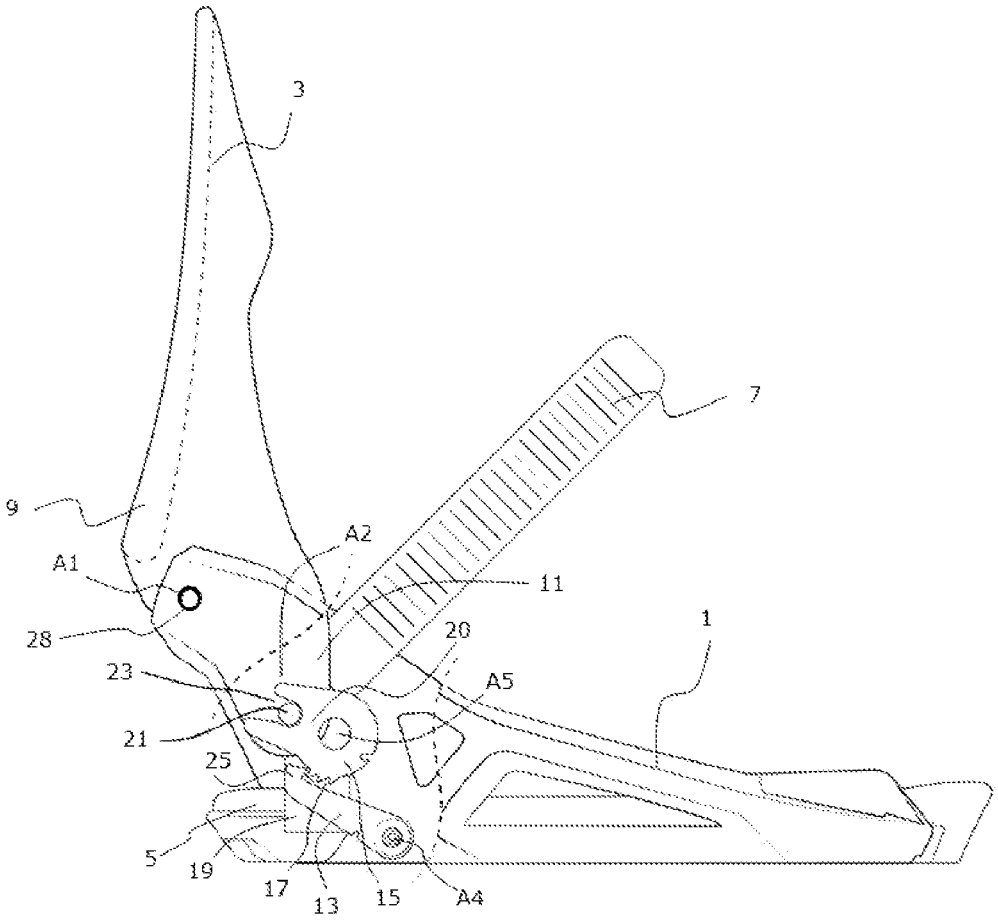
FIG. 7 is a side view of an example of a variant of the first embodiment of the invention, where the lug is supported by the bearing highback.

Thus, the FIG. 7 shows a variant of the first embodiment, that is different from the example of the FIG. 2 in that the rotation axis A1 of the bearing highback 3 relative to the baseplate 1 goes through two pivot links 28 on each of the two sides 11 of the bearing highback. Contrarily to the examples of the previous figures, the two pivot links 28 do not form a hinge bearing, but only two punctiform joints, like rivets.

The invention claimed is:

1. A snowboard binding comprising: a baseplate, a bearing highback rotatable relative to the baseplate, a pedal to operate the bearing highback at clip-in between an opening position and a closing position and a locking element to lock the rotation of the bearing highback relative to the baseplate in a closing position against an elastic return of a lever, wherein the locking element includes two ratchet notches with the lever, wherein a lug that is received into a fork of the locking elements with notches or of the lever to rotate the locking element with notches or the lever by unlocking the lever from one of the notches and by locking it with the other notch at clip-in.

2. The snowboard binding according to the claim 1, wherein the lug is static in the baseplate, the bearing highback or the pedal.

3. The snowboard binding according to the claim 2, wherein the locking element with notches is a wheel with a recess that defines the fork that will receive the lug.

4. The snowboard binding according to the claim 3, wherein the wheel is rotatable relative to the bearing highback and the lug is static in the baseplate or the wheel is rotatable relative to the baseplate and the lug is static in the bearing highback or in the pedal.

5. The snowboard binding according to the claim 2, wherein the lug is supported by a side of the bearing highback.

6. The snowboard binding according to the claim 2, wherein the lever comprises a first arm rotatable relative to the bearing highback and a second arm that is joint to the first arm and snapped with the locking element with notches, being static in the bearing highback, wherein the first arm includes a recess that defines the fork opposite to the second arm, while the lug is static in the baseplate.

7. The snowboard binding according to the claim 6, wherein the first arm of the lever is a hoop joint to two sides of the bearing highback.

* * * * *